US012606770B2

(12) United States Patent
McCune et al.

(10) Patent No.: US 12,606,770 B2
(45) Date of Patent: Apr. 21, 2026

(54) HYBRID GREASES MADE WITH ANHYDROUS METAL SOAPS AND OVER-BASED METAL DETERGENTS AND METHODS OF MAKING

(71) Applicant: The Lubrizol Corporation, Wickliffe, OH (US)

(72) Inventors: Devon K. McCune, Lyndhurst, OH (US); Robert D. Dura, Broadview Heights, OH (US); Gareth Fish, Munson Township, OH (US); Jennifer E. Clark, Aurora, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/756,744

(22) Filed: Jun. 27, 2024

(65) Prior Publication Data

US 2025/0027006 A1 Jan. 23, 2025

Related U.S. Application Data

(60) Provisional application No. 63/527,152, filed on Jul. 17, 2023.

(51) Int. Cl.

| | |
|---|---|
| ***C10M 169/00*** | (2006.01) |
| ***C10M 101/02*** | (2006.01) |
| ***C10M 117/04*** | (2006.01) |
| ***C10M 129/08*** | (2006.01) |
| ***C10M 135/10*** | (2006.01) |
| ***C10M 141/08*** | (2006.01) |
| ***C10M 177/00*** | (2006.01) |
| *C10N 30/00* | (2006.01) |
| *C10N 30/04* | (2006.01) |
| *C10N 50/10* | (2006.01) |
| *C10N 80/00* | (2006.01) |

(52) U.S. Cl.

CPC ..... *C10M 169/00* (2013.01); *C10M 101/02* (2013.01); *C10M 117/04* (2013.01); *C10M 129/08* (2013.01); *C10M 135/10* (2013.01); *C10M 141/08* (2013.01); *C10M 177/00* (2013.01); *C10M 2201/02* (2013.01); *C10M 2203/1006* (2013.01); *C10M 2207/022* (2013.01); *C10M 2207/1285* (2013.01); *C10M 2219/044* (2013.01); *C10M 2219/046* (2013.01); *C10N 2030/04* (2013.01); *C10N 2030/52* (2020.05); *C10N 2050/10* (2013.01); *C10N 2080/00* (2013.01)

(58) Field of Classification Search

CPC ..... C10N 2050/10; C10N 2070/00; C10N 2010/04; C10N 2020/02; C10N 2030/04; C10N 2080/00; C10N 2010/02; C10N 2030/52; C10M 177/00; C10M 169/00; C10M 141/08; C10M 129/08; C10M 135/10; C10M 163/00; C10M 101/02; C10M 117/04; C10M 2207/022; C10M 2223/045; C10M 2207/1285; C10M 2209/1055; C10M 2033/1006; C10M 2207/166; C10M 2207/2626; C10M 2215/064; C10M 2201/02; C10M 2207/028; C10M 2219/044; C10M 2219/0466; C10M 2203/1025; C10M 2209/1045; C10M 2205/0285; C10M 2207/1265; C10M 2203/1065; C10M 2219/046; C10M 2219/022; C10M 2209/1033

See application file for complete search history.

(56) References Cited

U.S. PATENT DOCUMENTS 6,063,742 A * 5/2000 Konzman ..... C10M 137/02 508/423

2017/0335223 A1 11/2017 Waynick

OTHER PUBLICATIONS

Dabo Liu; Ming Zhang; Gaiqing Zhao; Xiabob Want, "Tribological Behavior of Amorphous and Crystalline Overbased Calcium Sulfonate as Additives in Lithium Complex Grease", Tribol Lett, Aug. 3, 2011, pp. 265-273, Springer Science-Business Media, LLC, China.

* cited by examiner

*Primary Examiner* — Vishal V Vasisth

(74) *Attorney, Agent, or Firm* — Iken S. Sans; Michael A. Miller

(57) ABSTRACT

Greases that are suitable for use in high temperature applications and are cost-effective alternatives to lithium greases. The greases are prepared from an oil of lubricating viscosity; 1.0 to 22.5 wt % of an overbased metal detergent; 5.0 to 18.5 wt % of a metal carboxylate soap component that is the reaction product of a metal hydroxide and/or metal carbonate with a fatty acid; 0.2 to 8.0 wt % of an oxygenate promoter (for example alcohols and/or organic acids); and 1 to 15 wt % of water. The greases have dropping points of at least 220° C., as measured using ASTM D2265.

21 Claims, No Drawings

HYBRID GREASES MADE WITH ANHYDROUS METAL SOAPS AND OVER-BASED METAL DETERGENTS AND METHODS OF MAKING

CROSS REFERENCE TO RELATED APPLICATION

This application claims the priority of U.S. Provisional Application No. 63/527,152 filed on Jul. 17, 2023.

FIELD OF THE INVENTION

The field of the disclosed technology is generally related to greases prepared from a mixture of metal carboxylate soaps and overbased metal detergents and methods of making the same.

BACKGROUND OF THE INVENTION

It is important to consider the heat resistance of a grease to ensure its lubricating performance in higher-temperature applications. One way to get an indication of a grease's heat resistance is to measure its dropping point. The dropping point, as defined by ASTM D2265, is a numerical value assigned to a grease composition representing the corrected temperature at which the first drop of material falls from the test cup and reaches the bottom of the test tube. At temperatures above 200° C., the dropping point test is applied as a quality control tool to ensure that the thickener system has been correctly made. Hydrated calcium soaps, or cup greases, offer the lowest cost position of any grease thickeners. However, due to their low dropping points, they are typically limited to applications with a maximum temperature of about 80° C. Anhydrous calcium soaps, manufactured from hydrated lime and 12-hydroxystearic acid will typically have a dropping point ranging between 150-160° C. and are also relatively low cost and easy to use as grease thickeners.

Most specifications for multi-purpose commodity greases, however, require the dropping point to be above 175° C. It is common to use conventional (anhydrous) lithium 12-hydroxystearate soap in multi-purpose applications as its dropping point is around 200° C. The dropping point in both lithium 12-hydroxystearate and calcium 12-hydroxystearate soap or anhydrous grease types can be increased by adding a borate-containing additives, such as a borate ester. Conventional lithium 12-hydroxystearate greases treated with a complexing agent such as boron-containing additives will have dropping points of around 260° C., whereas anhydrous calcium greases will typically have a dropping point of only around 180° C.

Over the last few years, overbased metal detergent greases, typically based on overbased calcium sulfonates, have become more common in industrial applications. These greases can perform to around 160° C. and have dropping points above 300° C. These greases are typically a significant cost premium of 50% over commodity lithium greases, and 30% over lithium greases thermally stabilized with boron-containing additives.

Due to the increased demand for lithium batteries in the electronics and electric car markets, however, the price of lithium hydroxide has increased significantly, driving up the cost of lithium greases to levels that are no longer tolerable in the global grease market. As such, there is a need for a more cost-effective alternative to commodity lithium greases.

SUMMARY OF THE INVENTION

The disclosed technology, therefore, provides a more cost-effective alternative to lithium greases that has improved temperature stability in high temperature applications. These greases are made using a combination of metal carboxylate soaps and overbased metal detergents and have higher dropping points than greases made with anhydrous calcium soaps and are on a performance par with lithium 12-hydroxystearate soap thickened greases.

Accordingly, greases prepared from an oil of lubricating viscosity; 1.0 to 22.5 wt % of an overbased metal detergent solubilized in a liquid diluent; 5 to 18.5 wt % (or 9.0 to 18.5 wt %) of a metal carboxylate soap component that is the reaction product of a metal hydroxide and/or metal carbonate with a fatty acid; 0.2 to 8.0 wt % (or 0.2 to 5 wt %) of an oxygenate promoter (for example alcohols and/or organic acids); and 1 to 15 wt % of water are disclosed.

In some embodiments, the overbased metal detergent may be present in a range of 5 to 15 wt %, or 10 to 15 wt %, based on a total yield of the grease. The overbased metal detergent may have a total base number (TBN) of 150 to 500 (or 200 to 500, 300 to 400, or 400) mg KOH/g equivalents. In some embodiments, the solubilized overbased metal detergent contains no more the 75 wt % (or no more than 70, or 60, or 55 wt %) of the liquid diluent. Suitable overbased metal detergents include overbased metal sulfonates, salicylates, naphthenates, phenates or oleate detergents, or mixtures thereof. These overbased metal detergents may be prepared from at least one overbased alkali or alkaline earth metal salt, for example, sodium salts, calcium salts, magnesium salts, barium salts, lithium salts, potassium salts or mixtures thereof. In some embodiments, the overbased metal detergent is an overbased calcium sulfonate detergent, optionally having a TBN of 400 mg KOH/g equivalents.

The metal carboxylate soap may be the reaction product of 0.5 to 2.1 wt % (or 1.5 wt %) of a metal hydroxide with 5 to 16 wt % (or 11.3 wt %) of a fatty acid, wherein the metal hydroxide comprises at least one alkali or alkaline earth metal hydroxide (for example sodium hydroxide, calcium hydroxide, magnesium hydroxide, barium hydroxide, lithium hydroxide, potassium hydroxide, or mixtures thereof). In some embodiments, the metal hydroxide is calcium hydroxide. The fatty acid may comprise at least one of oleic acid, stearic acid (for example 12-hydroxystearic acid), ricinoleic acid, or combinations thereof.

The oxygenate promoter used to prepare the grease may be an organic acid and/or an alcohol. Suitable organic acids include, but are not limited to acetic acid, succinic acid, phosphoric acid, sulfamic acid, 2-acrylamido 2-methyl propane sulfonic acid, alkylated benzene sulfonic acid, or combinations thereof. Suitable alcohols include, but are not limited to, methanol, isopropanol, 2-methoxyethanol, propylene glycol (which may be a mixture of 1,2- and 1,3-propanediols), dipropylene glycol, butanol, amyl alcohol, 2-ethyl-1,3-hexanediol, 2-methyl-2-4-pentanediol, 2-methoxyethanol, diethylene glycol monobutyl ether, 1,2-hexanediol, 1,2-butanediol, 2,3-butanediol, 1,3-butanediol, 2,5-dimethyl-2,5-hexanediol, 2-butyl-2-ethyl-1,3-propanediol, triethylene glycol methyl ether, 3-methyl-1,3-butanediol, 1,2-pentanediol, 2-butoxyethanol, or combinations thereof.

The oil of lubricating viscosity comprises at least one paraffinic oil, naphthenic oil, polyalphaolefin, liquid ethylene oxide/propylene oxide copolymers, polyalkylene glycol, seed oil, vegetable oil, esters, or mixtures thereof. In some embodiments, the oil of lubricating viscosity may comprise at least one API Group I, II, III, IV, or V oil, or ATIEL Group VI, or mixtures thereof. In yet other embodiments, the oil of lubricating viscosity may be an API Group II oil.

In some embodiments, the grease may comprise at least one additive to improve one or more of the grease's performance characteristics. The additives may include, but are not limited to, an antiwear agent, friction modifier, extreme pressure agent, corrosion inhibitor, antioxidant, viscosity modifier, tackifier, or mixtures thereof.

The resulting grease maybe a hybrid grease comprising both an anhydrous metal soap and an overbased metal detergent. Methods of making a hybrid grease are also disclosed. The methods may include making a hybrid grease in two steps, steps (I) and (II). Step (I) may comprise the step of: admixing (i) an oil of lubricating viscosity; (ii) 0.5 to 2.1 wt % (or 1.5 wt %) of a metal hydroxide and/or metal carbonate; and (iii) 5 to 16 wt % (or 11.3 wt %) of a fatty acid and (iv) 1 to 15 wt % of water to form an anhydrous grease. The admixture of step (I) may be mixed and heated between 70 and 90° C. for 1 to 2 hours, until it is saponified and forms an anhydrous grease.

For step (II), the resulting the anhydrous grease may then be admixed with (i) 1 to 22.5 wt % (or 12 wt %) of an overbased metal detergent solubilized in a liquid diluent, (ii) 0.2 to 5.0 wt % of an oxygenate promoter (for example alcohols and/or organic acids), and (iii) 1 to 15 wt % of water to form the hybrid grease. The admixture of step (II) may be mixed at 70 to 95° C. for 1 to 2 hours. The resulting hybrid grease of step (II) may have an FTIR peak ranging from 850 to 900, or 870 to 890 cm-1. The dropping point of the hybrid grease may be greater than 220° C., 250° C., or 300° C., as measured using a dropping point test (for example ASTM D2265, ISO 2176, or IP 396).

DETAILED DESCRIPTION OF THE INVENTION

Novel greases made using a combination of metal carboxylate soaps and overbased metal detergents are disclosed herein. These greases have higher dropping points than greases made with anhydrous metal soaps. Various preferred features and embodiments will be described below by way of non-limiting illustrations.

The greases may be prepared from an oil of lubricating viscosity; 1.0 to 22.5 wt % of an overbased metal detergent; 5.0 to 18.5 wt % (or 9.0 to 18.5 wt %) of a metal carboxylate soap component that is the reaction product of a metal hydroxide and/or metal carbonate with a fatty acid; 0.2 to 8.0 wt % or (or 0.2 to 5 wt %, or 0.5 to 5.0 wt %) of an oxygenate promoter (for example alcohols and/or organic acids); and 1 to 15 wt % of water.

Overbased Metal Detergent

The greases may be prepared using any overbased metal detergent known in the art. Overbased metal detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may comprise one or more of non-sulfur containing phenates, sulfur containing phenates, sulfonates, salicylates, and mixtures thereof. Alternatively, the overbased metal detergent may comprise at least one overbased metal sulfonate, salicylate, naphthenate, or oleate detergent, or mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased detergent may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g. phenate-salicylates, sulfonate-phenates, sulfonate-salicylates, and sulfonates-phenates-salicylates. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Overbased detergents may be characterized by Total Base Number (TBN), the amount of strong acid needed to neutralize all of the material's basicity, expressed as mg KOH per gram of sample. TBN is a very well-known parameter that is described in ASTM D4739. Since the overbased detergents, as used herein, commonly provided in a form which contains liquid diluent, for the purpose of this document, TBN is to be recalculated to an oil-free basis. Various detergents may have a TBN of 100 to 1000, or 150 to 800, or, 400 to 700. The detergents may have a TBN of at least 640, for instance, 650 to 1000, or even 680 to 800. In each case, the units are mg KOH/g equivalents. Overbased phenates and salicylates typically have a total base number of 180 to 450. Overbased sulfonates typically have a total base number of 250 to 600, or 300 to 500.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms.

The overbased metal-containing detergent may be alkali metal or alkaline earth metal salts. In one embodiment, the overbased detergent may be sodium salts, calcium salts, magnesium salts, barium salts, lithium salts or mixtures thereof of the phenates, sulfur-containing phenates, sulfonates, salixarates, salicylates, naphthalenes, naphthenates, or oleates, or mixtures thereof. In one embodiment, the overbased detergent is a calcium detergent, a magnesium detergent or mixtures thereof. In one embodiment, the overbased detergent is free of or substantially free of sodium.

Salicylate detergents and overbased salicylate detergents may be prepared in at least two different manners. In a first manner, the detergent may be prepared via carbonylation (also referred to as carboxylation) of a p-alkylphenol followed by overbasing to form overbased salicylate detergent.

Suitable p-alkylphenols include those with linear and/or branched hydrocarbyl groups of 1 to 60 carbon atoms. Salicylate detergents may also be prepared by alkylation of salicylic acid, followed by overbasing. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms.

In one embodiment, the overbased metal-containing detergent may be a predominantly a linear alkylbenzene sulfonate detergent having a metal ratio of at least 8. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Accordingly, in some embodiments, the overbased metal detergent may have a total base number (TBN) of 150 to 500 (or 200 to 500, 300 to 400, or 400) mg KOH/g equivalents mg KOH/g equivalents. Suitable overbased metal detergents include overbased metal sulfonates, salicylates, naphthenates, phenates or oleate detergents, or mixtures thereof. These overbased metal detergents may be prepared from at least one overbased alkali or alkaline earth metal salt, for example, sodium salts, calcium salts, magnesium salts, barium salts, lithium salts, potassium salts or mixtures thereof. In some embodiments, the overbased metal detergent is an overbased calcium sulfonate detergent, optionally having a TBN of 400 mg KOH/g equivalents. In some embodiments, the overbased metal detergent may be present in a range of 1 to 22.5 wt %, or 5 to 15 wt %, or 12 wt %, based on a total yield of the grease.

The solubilized overbased metal detergent may be solubilized in a liquid diluent. The liquid diluent is not overly limited and include those known in the art. The liquid diluent may be selected based on the substrate type, the overbasing process, or even the intended end-use of the overbased detergent. Suitable liquid diluents include mineral oils (including food-grade white oils) and polyalphaolefins. For the greases disclosed herein, the solubilized overbased metal detergent contains no more the 75 wt % (or no more than 70, or 60, or 55 wt %) of the liquid diluent. In some embodiments, the solubilized overbased metal detergent contains 30 to 40 wt % of a liquid diluent that is a mineral oil. The diluent oil may be and ISO viscosity grade (VG) of 22 to 32. An oil of lubricating viscosity may also be used as the diluent oil with a kinematic viscosity in the range ISO VG 46 to ISO VG 150.

Metal Carboxylate Soap

The metal carboxylate soap may be the reaction product of a metal hydroxide with a fatty acid, wherein the metal hydroxide comprises at least one alkali or alkaline earth metal hydroxide (for example sodium hydroxide, calcium hydroxide, magnesium hydroxide, barium hydroxide, lithium hydroxide, potassium hydroxide, or mixtures thereof). In some embodiments, the metal hydroxide is calcium hydroxide. The fatty acid may comprise at least one of oleic acid, stearic acid (for example 12-hydroxystearic acid), ricinoleic acid, or combinations thereof. The metal carboxylate soap may be present at 5.0 to 18.5 wt %, or 9 to 18.5 wt %, or 12 to 13 wt %, based on a total yield of the grease.

Oxygenate Promoter

Oxygenate promoters may be used to reduce conversion time and facilitate grease formation. Suitable oxygenate promoters are not overly limited and include any promoter known in the art, for example water, alcohols, acids, or mixtures thereof.

Accordingly, in some embodiments, the oxygenate promoter used to prepare the grease may be an organic acid and/or an alcohol. Suitable organic acids include, but are not limited to acetic acid, succinic acid, phosphoric acid, sulfamic acid, 2-acrylamido 2-methyl propane sulfonic acid, alkylated benzene sulfonic acid, or combinations thereof. In one embodiment, the alkylated benzene sulfonic acid may be a $C_9$ to $C_{12}$, or $C_{10}$-$C_{13}$ or $C_9$-$C_{16}$ alkylated benzene sulfonic acid. Suitable alcohols include, but are not limited to, methanol, isopropanol, 2-methoxyethanol, propylene glycol (which may be a mixture of 1,2- and 1,3-propanediols), dipropylene glycol, butanol, amyl alcohol, 2-ethyl-1,3-hexanediol, 2-methyl-2-4-pentanediol, 2-methoxyethanol, diethylene glycol monobutyl ether, 1,2-hexanediol, 1,2-butanediol, 2,3-butanediol, 1,3-butanediol, 2,5-dimethyl-2,5-hexanediol, 2-butyl-2-ethyl-1,3-propanediol, triethylene glycol methyl ether, 3-methyl-1,3-butanediol, 1,2-pentanediol, 2-butoxyethanol, or combinations thereof. The oxygenate promoter may be present at 0.2 to 5 wt %, or 0.2 to 5 wt %, or 0.5 to 2.5 wt %, based on a total yield of the grease.

Oil of Lubricating Viscosity

One of the components of a grease composition is an oil of lubricating viscosity. These include natural and synthetic oils of lubricating viscosity, oils derived from hydrocracking, hydrogenation, or hydrofinishing, and unrefined, refined, and re-refined oils and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil.

Often Fischer-Tropsch hydrocarbons or waxes may be hydroisomerized. In one embodiment the base oil comprises a polyalphaolefin including a PAO-2, PAO-4, PAO-5, PAO-6, PAO-7, or PAO-8. The polyalphaolefin in one embodiment may be prepared from octene, decene, dodecene, or mixtures thereof. Additional suitable polyalphaolefins metallocene polyalphaolefins. In one embodiment the oil of lubricating viscosity comprises an ester such as an adipate.

Oils of lubricating viscosity may also be defined as specified in the American Petroleum Institute (API) Base Oil Interchangeability Guidelines.

Viscosity Index

| Base Oil Category | Sulfur (%) | Saturates (%) | Viscosity Index |
|---|---|---|---|
| Group I | >0.03 and/or | <90 | 80 to less than 120 |
| Group II | ≤0.03 and | ≥90 | 80 to less than 120 |
| Group III | ≤0.03 and | ≥90 | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

Oils of lubricating viscosity may also be defined as specified in the Technical Association of the European Lubricants Industry (ATIEL) Base Oil Interchangeability Guidelines. The ATIEL guidelines include a base oil category for polyinternalolefins, ATIEL Group VI.

Accordingly, in some embodiments, the oil of lubricating viscosity may comprise at least one paraffinic oil, naphthenic oil, liquid ethylene oxide/propylene oxide copolymers, polyalphaolefin, polyalkylene glycol, seed oil, vegetable oil, esters, or mixtures thereof. In some embodiments, the oil of lubricating viscosity may comprise at least one API Group I, II, III, IV, or V oil, or ATIEL Group VI, or mixtures thereof. In another embodiment the oil of lubricating viscosity is a Group II base oil, which may include polybutene and/or polyisobutylene to boost viscosity and improve tackiness and water handling properties.

The amount of the oil of lubricating viscosity present is typically the balance remaining after subtracting from about 100 wt % the sum of the amount of the other components used to make the grease disclosed herein, including any of the performance additives described below. Generally, the oil of lubricating viscosity may be present in at least 50 wt %, based on a total weight of the grease composition. In some embodiments, the grease is present at 50 to 90 wt %, or 60 to 80 wt %, or 65 to 75 wt %, based on a total weight of the grease composition.

Additional Performance Additives

In some embodiments, the grease may comprise at least one additive to improve one or more of the grease's performance characteristics. The additives may include, but are not limited to, an antiwear agent, friction modifier, extreme pressure agent, corrosion inhibitor, antioxidant, viscosity modifier, tackifier, or mixtures thereof. These additives may help improve the wear or friction properties of the grease. Some additives, such as antioxidants, may help improve the stability of the grease and/or make it less reactive to other materials in the environment. The grease may also contain corrosion inhibitors to help inhibit corrosion of metals that the grease is in contact with.

Typically, the antiwear agent may be a phosphorus antiwear agent. The antiwear agent may be present at 0 wt % to 5 wt %, 0.001 wt % to 2 wt %, 0.1 wt % to 2.0 wt % of the grease. The phosphorus antiwear agent may include a phosphorus amine salt, calcium salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. In one embodiment the oil soluble phosphorus amine salt includes partial amine salt-partial metal salt compounds or mixtures thereof. In one embodiment the phosphorus compound further includes a sulfur atom in the molecule. In another embodiment the phosphorus compound is a derivative of calcium.

Additional examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

In one embodiment the antiwear additives may include a zinc dialkyldithiophosphate. In other embodiments the grease is substantially free of, or even completely free of zinc dialkyldithiophosphate. In yet another embodiment, the grease includes a dithiocarbamate antiwear agent defined in U.S. Pat. No. 4,758,362 column 2, line 35 to column 6, line 11. When present, the dithiocarbamate antiwear agent may be present from 0.25 wt %, 0.3 wt %, 0.4 wt % or even 0.5 wt % up to 3.0 wt %, 2.5 wt %, 2.0 wt % or even 0.55 wt % in the overall composition.

In some embodiments, the grease may comprise one or more extreme pressure agents. Suitable extreme pressure agents include organo-sulfides. In one embodiment the organo-sulfide comprises at least one of a polysulfide, thiadiazole compound, or mixtures thereof. The extreme pressure agent may be present in a range of 0 wt % to 10 wt %, 0.01 wt % to 10 wt %, 0.1 wt % to 8 wt %, 0.25 wt % to 6 wt %, 2 wt % to 5 wt %, or 3 wt % to 5 wt % of the grease.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Further examples of thiadiazole compounds are found in WO 2008/094759, paragraphs 0088 through 0090.

The organosulfide may alternatively be a polysulfide. In one embodiment at least about 50 wt % of the polysulfide molecules are a mixture of tri- or tetra-sulfides. In other embodiments at least about 55 wt %, or at least about 60 wt % of the polysulfide molecules are a mixture of tri- or tetra-sulfides. The polysulfides include sulfurized organic polysulfides from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide may also be derived from an olefin derived from a wide range of alkenes, typically having one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene, or mixtures thereof. In one embodiment the polysulfide comprises a polyolefin derived from polymerizing, by known techniques, an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts; phosphorosulfurized hydrocarbons.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (which may also be referred to as a detergent), metal salts of sulfonates (which may also be referred to as a detergent), condensation products of carboxylic acids or polyalkylene-polyamines, or amides of hydroxyalkyl compounds. In one embodiment the friction modifier includes a fatty acid ester of glycerol. The fatty acids may contain 6 to 24, or 8 to 18 carbon atoms. In one embodiment the friction modifier may comprise the product of isostearic acid with tetraethylenepentamine. A more detailed list of possible friction modifiers is found in WO 2008/094759, paragraphs 0100 through 0113. The friction modifier may be present in an amount of 0 wt % to 7 wt %, 0.1 wt % to 6 wt %, 0.25 wt % to 5 wt %, or 0.5 wt % to 5 wt % of the grease.

In some embodiments the grease may comprise at least one metal deactivator (often called corrosion inhibitors). The metal deactivators may comprise one or more derivatives of benzotriazole, 2-alkyldithiobenzimidazoles, 2-alkyldithiobenzothiazoles, 2-(N,N-dialkyldithiocarbamoyl) benzothiazoles, 2,5-bis (alkyldithio)-1,3,4-thiadiazoles, 2,5-bis (N,N-dialkyldithiocarbamoyl)-1,3,4-thiadiazoles, 2-alkyldithio-5-mercaptothiadiazoles or mixtures thereof.

The benzotriazole compounds may include hydrocarbyl substitutions at one or more of the following ring positions 1- or 2- or 4- or 5- or 6- or 7-benzotriazoles. The hydrocarbyl groups may contain from 1 to 30 carbons, and in one embodiment from 1 to 15 carbons, and in one embodiment from 1 to 7 carbons. The metal deactivator may comprise 5-methylbenzotriazole. The metal deactivator may be present in the grease composition at a concentration in the range up to 5 wt %, or 0.0002 to 2 wt %, or 0.001 to 1 wt %.

In some embodiments the grease may comprise at least one rust inhibitor (often called corrosion inhibitors). The rust inhibitor may comprise one or more metal sulfonates such as calcium sulfonate or magnesium sulphonate or barium sulfonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from 8 to 24 carbon atoms with alcohols such as polyglycols.

The rust inhibitors may present in the grease composition at a concentration in the range up to 4 wt %, and in one embodiment in the range from 0.02 wt % to 2 wt %, and in one embodiment in the range from 0.05 wt % to 1 wt %.

In one embodiment the grease composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition. Antioxidants include diarylamine alkylated diarylamines, hindered phenols, dithiocarbamates, 1,2-dihydro-2,2,4-trimethylquinoline, hydroxyl thioethers, or mixtures thereof.

The diarylamine alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine such as Lubrizol™ GR9510, octyl diphenylamine, di-octylated diphenylamine, or di-decylated diphenylamine. The alkylated diarylamine may include octyl, di-octyl, nonyl, di-nonyl, decyl or di-decyl phenylnapthylamines. In one embodiment the alkylated diphenylamine may comprise at least one of octylated diphenylamine, butylated diphenylamine, or mixtures thereof e.g. Irganox™ L57 from BASF.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. The bridging atom may be carbon or sulfur. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L135 from BASF. A more detailed description of suitable ester-containing hindered phenol antioxidant chemistry is found in U.S. Pat. No. 6,559,105.

The dithiocarbamate antioxidant may be metal containing such as molybdenum or zinc dithiocarbamate or it may be "ashless". Ashless refers to the dithiocarbamate as containing no metal and the linking group is typically a methylene group. The 1,2-dihydro-2,2,4-trimethylquinoline may be present as a unique molecule or oligomerized with up to 5 repeat units and known commercially as "Resin D" or simply "RD", available from a number of suppliers.

Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, and mixtures thereof. Viscosity modifiers may include star polymers, e.g., as described in US Pub. No. 2012/0101017 A1.

The grease composition may additionally or alternatively include one or more dispersant viscosity modifiers. Suitable dispersant viscosity modifiers include functionalized polyolefins, for example, ethylene-propylene copolymers that have been functionalized with the reaction product of an acylating agent (such as maleic anhydride) and an amine; polymethacrylates functionalized with an amine; esterified maleic anhydride-styrene copolymers reacted with an amine, and mixtures thereof.

The one or more viscosity modifier(s), when present, may be, in total, at least 0.01 wt. %, or at least 0.1 wt. %, or at least 0.5 wt. %, or up to 10 wt. %, or up to 5 wt. %, or up to 3 wt. %, of the grease composition.

The tackifier may be polybutene and/or polyisobutylene with a number average molecular weight of 2000 to 4000. Examples of commercially available tackifiers and their chemical types may include the following: polyisobutylenes (such as Indopol™ from Ineos or Parapol™ from ExxonMobil); olefin copolymers (such as Lubrizol™, 7065c, and 7067c from Lubrizol and Lucant™ HC-2000L HC-1000 and HC-600 from Mitsui); hydrogenated styrene-isoprene copolymers (such as Shellvis™ 40 and 50, from Infineum or Functional Products and Lubrizol™ 7306, and 7308 from Lubrizol); styrene/butadiene copolymers such as Lubrizol™ 7408A from Lubrizol); Concentrations of 0.2 to 3% by weight, based on a total weight of the grease composition may also be used.

Methods of making a grease are also disclosed. The grease preparation method may be carried out in an open or closed kettle, as is commonly used for grease manufacturing, or in a pressurized reactor. The process can be achieved at normal atmospheric pressure although it can be carried out under pressure in a closed pressurized reactor or autoclave. In one embodiment, the method is carried out in an open kettle. Post-processing of the greases may include one or more steps of milling, filtering, adding performance additives and packaging the grease, and is done in a manner that those familiar with grease manufacture would know.

The methods may include making a hybrid grease in two steps, steps (I) and (II). Step (I) may comprise the step of: admixing (i) an oil of lubricating viscosity; (ii) 0.5 (or 1 to 2.1 wt %, or 1.5 wt %) of a metal hydroxide and/or metal carbonate; (iii) 5 to 16 wt % (or 8 to16 wt %, or 11.3 wt %) of a fatty acid and (iv) 1 to 15 wt % (or 2 to 5 wt %) of water to form an anhydrous grease. The admixture of step (I) may be mixed and heated between 70 and 90° C. for 1 to 2 hours until it is saponified and forms an anhydrous grease. Conversion of the admixture to the anhydrous grease may be determined using Fourier transform infrared spectroscopy ("FTIR"). When converted, the grease should have at least one FTIR spectra peak between 1540 to 1600 $cm^{-1}$.

For step (II), the resulting the anhydrous calcium grease may then be admixed with (i) 1 to 22.5 wt % (or 12 wt %) of an overbased metal detergent, (ii) 0.2 to 8.0 wt % (or 0.5 to 5 wt %) of an oxygenate promoter (for example alcohols and/or organic acids), and (iii) 1 to 15 wt % (or 2 to 5 wt %) water, to form the hybrid grease. The admixture of step (II) may be mixed at 70 to 95° C. for 1 to 2 hours. The resulting hybrid grease of step (II) may have an FTIR peak ranging from 850 to 900, or 870 to 890 $cm^{-1}$. The dropping point of the hybrid grease may be greater than 220° C., 250° C., or 300° C., as measured using a dropping point test (for example ASTM D2265, ISO 2176, or IP 396).

The water used for both steps (I) and (II) helps promote the reaction of the various components. If excess water is used, it may be evaporated off in step (II) or as part of the finishing process. In some embodiments, the water used for both steps (I) and (II) ranges from 2 to 5 wt % and any excess water is evaporated off in step (II) or as part of the finishing process.

In one embodiment, the grease may be prepared from 54 to 90 wt % of a base oil (for example a Group II base oil), 1 to 2.1 wt % of a metal hydroxide (for example calcium hydroxide), 8 to 16 wt % of a fatty acid (for example 12-hydroxystearic acid), 1 to 15 wt % water, 1 to 22.5 wt % of an overbased metal detergent (for example overbased calcium sulfonate detergent), 0.2 to 2.5 wt % of an oxygenate promoter that is an alcohol (for example 2-ethyl-1,3-hexane diol), and 0.5 to 2.5 wt % of an oxygenate promoter that is an acid (for example an alkylated benzene sulfonic acid). In another embodiment, the grease may be prepared from 72.8 wt % of a base oil (for example a Group II base oil), 1.5 wt % of a metal hydroxide (for example calcium hydroxide), 11.3 wt % of a fatty acid (for example 12-hydroxystearic acid), 8 wt % water, 12 wt % of an overbased metal detergent (for example overbased calcium sulfonate detergent), 1.1 wt % of an oxygenate promoter that is an alcohol (for example 2-ethyl-1,3-hexane diol), and 1.3 wt % of an oxygenate promoter that is an acid (for example an alkylated benzene sulfonic acid). Additional details on making greases maybe found in the NLGI Lubricating Grease Guide.

As used herein, the term "hydrocarbyl" refers to a group having a carbon atom directly attached to the remainder of the molecule, where the group includes at least carbon and hydrogen atoms. If the hydrocarbyl group comprises more than one carbon atom, then those carbons need not necessarily be linked to each other. For example, at least two of the carbons may be linked via a suitable element or group. In various embodiments, the term "hydrocarbyl" refers to a group having a carbon atom directly attached to the remainder of the molecule, where the group consists of carbon, hydrogen, optionally one or more heteroatoms provided the heteroatoms do not alter the predominantly hydrocarbon nature of the substituent. The heteroatom may link at least two of the carbons in the hydrocarbyl group, and optionally no more than two non-hydrocarbon substituents. Suitable heteroatoms will be apparent to those skilled in the art and include, for instance, sulphur, nitrogen, oxygen, phosphorus and silicon.

Where the hydrocarbyl contains heteroatoms, optionally, no more than two heteroatoms will be present for every ten carbon atoms in the hydrocarbyl group. Suitable non-hydrocarbon substituents will also be apparent to those skilled in the art and include, for instance, halo, hydroxy, alkoxy, mercapto, alkylmercapto, nitro, nitroso, and sulfoxy.

Examples of hydrocarbyls within the context of the present technology therefore include:

- hydrocarbon groups selected from aliphatic (e.g. alkyl or alkenyl), alicyclic (e.g. cycloalkyl, cycloalkenyl, cycloalkadienyl), and aromatic groups;
- substituted hydrocarbon groups, selected from hydrocarbon groups defined in (i) substituted with no more than two non-hydrocarbon substituents and/or one or more hydrocarbon substituents, the non-hydrocarbon substituents being selected from the group consisting of halo, hydroxy, alkoxy, mercapto, alkylmercapto, nitro, nitroso, and sulfoxy;
- hetero-containing hydrocarbon groups, selected from hydrocarbon groups defined in (i) containing one or more heteroatom in the ring or chain, provided that the group has no more than two heteroatoms present for every ten carbon atoms in the group, the heteroatoms being selected from sulphur, nitrogen, oxygen, phosphorus and silicon. The hetero-containing hydrocarbon groups may be substituted with no more than two non-hydrocarbon substituents and/or one or more hydrocarbon substituents.

In some embodiments, the term "hydrocarbyl" refers to a group having carbon atoms directly attached to the remainder of the molecule, where the group consists of carbon and hydrogen atoms.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The grease making methods disclosed herein result in grease compositions that have dropping points of at least 220° C., or at least 250° C., and in some cases, at least 300° C., which makes these greases particularly useful in higher temperature applications and may be better understood with reference to the following examples.

EXAMPLES

Example A, Preparation of an Anhydrous Calcium Grease

For Example A, 75 wt % of a Group II base oil, 1.25 wt % of calcium hydroxide, 3 wt % water, and 8.4 wt % 12-hydroxystearic acid are added to a reaction vessel and mixed at room temperature for 30 minutes. The temperature is slowly increased to 70° C. and the temperature is maintained, while stirring, for 1 hour. The temperature is slowly increased again to about 120° C. (not to exceed 125° C.) and the temperature is maintained, while stirring, for 1 hour. The heat to the vessel is then turned-off and the remaining oil, 14.35 wt % is slowly added to the grease in the vessel. The grease is post-processed while it's hot.

Example B, Preparation of a Conventional (Anhydrous) Lithium Grease

For Example B, 43 wt % of a Group II base oil and 12.2 wt % of 12-hydroxystearic acid are added to a reaction vessel and mixed while heating to 90° C. Reserve another 43 wt % of the Group II base oil. In a separate vessel, heat 1.8 wt % of lithium hydroxide monohydrate and 5 times the amount of water to near boiling. Once the contents of the first reaction vessel reach 90° C., slowly add the lithium hydroxide solution to the first reaction vessel. Then, the temperature of the reaction vessel is slowly increased to 205° C. and some of the reserved base oil is added as needed. Once the contents of the reaction vessel reach 205° C., turn-off the heat to the vessel, but continue mixing. Once the grease is below 190° C., slowly add any of the remaining reserved Group II base oil. The grease is post-processed while it's hot.

Example C, Preparation of an Anhydrous 50/50 Calcium/Lithium Mixed Grease

For Example C, an anhydrous mixed grease is made with 50 wt % calcium soap to 50 wt % lithium soap. About 44 wt % of a Group II base oil and 10.15 wt % of 12-hydroxystearic acid are added to a reaction vessel and mixed while heating to 80° C. Reserve another 44 wt % of the Group II base oil. Once the acid is dissolved, add 0.74 wt % of lithium hydroxide monohydrate, 0.64 wt % calcium hydroxide, and 2.6 wt % water to the reaction vessel. Then, the temperature of the reaction vessel is slowly increased to 150° C. and held at that temperature for 1 hour while mixing. Slowly as the reserved Group II base oil and cool to 80° C. The grease is post-processed while it's hot.

Example D, Preparation of an Anhydrous 75/25 Calcium/Lithium Mixed Grease

For Example D, the same process is used as in Example C, except the anhydrous mixed grease is made with 75 wt % calcium soap to 25 wt % lithium soap.

Example E, Preparation of an Anhydrous 25/75 Calcium/Lithium Mixed Grease

For Example E, the same process is used as in Example C, except the an anhydrous mixed grease is made with 25 wt % calcium soap to 75 wt % lithium soap.

Example F (Inventive), Preparation of an Anhydrous/Complex Hybrid Grease

For Example F, 60 wt % (600 g) of a Group II base oil, 1.25 wt % (12.5 g) calcium hydroxide, 9.4 wt % (94 g) 12-hydroxystearic acid, and 2 wt % (20 g) water are added to a reaction vessel and mixed while heating to 70° C. and held for 1.5 hours. The conversion is checked using FTIR. There should be peaks around 1540 and 1580 $cm^{-1}$. Then, add 0.99 wt % (9.9 g) 2-ethyl-1,3-hexanediol, 12.0 wt % (120 g) overbased calcium sulfonate (400TBN), and 3 wt % (30 g) water. Then slowly add 1.3 wt % (13 g) dodecylbenzene sulfonic acid and increase the temperature to 90° C. Hold at 90° C. and check grease conversion using FTIR. There should be a peak around 875 $cm^{-1}$. Once conversion is complete, the temperature of the reaction vessel is slowly increased to 125° C. and another 15.06 wt % (150.6 g) of the Group II base oil is slowly added. The grease is then allowed to cool to 80° C. The grease is post-processed while it's hot.

Example G (Inventive), Preparation of an Anhydrous/Complex Hybrid Grease

For Example G, an anhydrous mixed grease is made using the same process as Example F above, except 2.5 wt % of a high-performance multipurpose ("HPM") additive package was added to the grease during post-processing. The additive package comprised an antioxidant that is an alkylated arylamine, zinc dialkyldithiophosphate antiwear additive, zinc neodecanoate rust inhibitor, and a combination of sulfurized olefin extreme pressure additives.

Example H (Inventive), Preparation of an Anhydrous/Complex Hybrid Grease

For Example H, 58.24 wt % of a Group II base oil, 1.5 wt % calcium hydroxide, 11.3 wt % 12-hydroxystearic acid, and 2.96 wt % water are added to a reaction vessel and mixed at room temperature for 30 minutes. The contents are mixed continuously and heated to 70° C. and maintained at temperature for 1 hour. The conversion is checked using FTIR. There should be peaks around 1540 and 1580 $cm^{-1}$. Once conversion is complete, add 1.1 wt % 2-ethyl-1,3-hexanediol, 12.0 wt % overbased calcium sulfonate (400TBN), and 5.84 wt % water and mix at 70° C. for 30 minutes. Then slowly increase the temperature to 90° C. and mix for 1.5 hours. The conversion is checked again using FTIR. There should be a peak around 875 cm-1. Then, the temperature of the reaction vessel is slowly increased to 120° C. and held for 1 hour. Then, turn-off the heat to the vessel and slowly add 14.56 wt % Group II base oil and allow the grease to cool to 80° C. The grease is post-processed while it's hot.

The dropping point of the greases were measuring using ASTM D2265. The results are shown in Table 1 below.

TABLE 1

| Example | Grease Type | Dropping Point by ASTM D2265 |
|---|---|---|
| A | Anhydrous Calcium | 162° C. |
| D | Anhydrous 75/25 Ca/Li | 174° C. |
| C | Anhydrous 50/50 Ca/Li | 190° C. |
| E | Anhydrous 25/75 Ca/Li | 203° C. |
| B | Conventional Lithium | 214° C. |
| F | Hybrid Anhydrous/Complex Ca | 221° C. |
| G | Example F + additives | 251° C. |
| H | Hybrid Anhydrous/Complex Ca | 305° C. |

As shown in Table 1, the hybrid greases have higher dropping points than the anhydrous lithium grease, providing a more cost-effective alternative to lithium greases that is suitable for use in both normal temperature and higher temperature applications.

Applications

The greases described herein find application as an a High-performance Multipurpose (HPM) grease and as a High Load Carrying (HPM+HL) grease, as defined by the NLGI. The greases also find use in applications that require high temperature and good load carrying capacity, such as in steel mill applications, heavy-duty industrial machinery, mining, and in food manufacturing.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A grease prepared from:

I. an oil of lubricating viscosity;

II. 1.0 to 22.5 wt % of an overbased metal detergent solubilized in a liquid diluent;

III. 5.0 to 18.5 wt % of a metal carboxylate soap component that is the reaction product of 0.5 to 2.1 wt % of an alkaline earth metal hydroxide with 5 to 16 wt % of a fatty acid, and wherein the alkaline earth metal hydroxide is calcium hydroxide, magnesium hydroxide, barium hydroxide, or mixtures thereof and wherein the fatty acid comprises at least one of oleic acid, stearic acid, ricinoleic acid, 12-hydroxystearic acid, or combinations thereof;

IV. 0.2 to 8.0 wt % of an oxygenate promoter; and

V. 1 to 15 wt % of water.

2. The grease of claim 1, wherein the solubilized overbased metal detergent has a total base number (TBN) of 150 to 500 mg KOH/g equivalents.

3. The grease of claim 1, wherein the solubilized overbased metal detergent contains no more the 75 wt % of the liquid diluent.

4. The grease of claim 1, wherein the solubilized overbased metal detergent is present in a range of 5 to 15 wt %, based on a total yield of the grease.

5. The grease of claim 1, wherein the overbased metal detergent is an overbased metal sulfonate, salicylate, naphthenate, phenate or oleate detergent, or mixtures thereof.

6. The grease of claim 1, wherein the overbased metal detergent is an overbased calcium sulfonate detergent.

7. The grease of claim 1, wherein the alkaline earth metal hydroxide is calcium hydroxide.

8. The grease of claim 1, wherein the oxygenate promoter comprises at least one acid that is acetic acid, succinic acid, phosphoric acid, sulfamic acid, 2-acrylamido 2-methyl propane sulfonic acid, alkylated benzene sulfonic acid, or combinations thereof.

9. The grease of claim 1, wherein the oxygenate promoter comprises at least one alcohol that is methanol, isopropanol, 2-methoxyethanol, propylene glycol, dipropylene glycol, butanol, amyl alcohol, 2-ethyl-1,3-hexanediol, 2-methyl-2-4-pentanediol, 2-methoxyethanol, diethylene glycol monobutyl ether, 1,2-hexanediol, 1,2-butanediol, 2,3-butanediol, 1,3-butanediol, 2,5-dimethyl-2,5-hexanediol, 2-butyl-2-ethyl-1,3-propanediol, triethylene glycol methyl ether, 3-methyl-1,3-butanediol, 1,2-pentanediol, 2-butoxyethanol, or combinations thereof.

10. The grease of claim 1, wherein the fatty acid is 12-hydroxystearic acid.

11. The grease of claim 1, wherein the oil of lubricating viscosity comprises at least one paraffinic oil, naphthenic oil, polyalphaolefin, liquid ethylene oxide/propylene oxide copolymers, polyalkylene glycol, seed oil, vegetable oil, esters, or mixtures thereof.

12. The grease of claim 1, wherein the oil of lubricating viscosity comprises at least one API Group I, II, III, IV, V oil, or ATIEL Group VI oil, or mixtures thereof.

13. The grease of claim 12, wherein the oil of lubricating viscosity comprises API Group II oil.

14. The grease of claim 1, further comprising as least one additive that is an antiwear agent, friction modifier, extreme pressure agent, corrosion inhibitor, antioxidant, viscosity modifier, tackifier, or mixtures thereof.

15. The grease of claim 1, wherein the grease is a hybrid grease.

16. A method of making a hybrid grease comprising the steps of:

I. admixing (i) an oil of lubricating viscosity; (ii) 0.5 to 2.1 wt % of an alkaline earth metal hydroxide, wherein the alkaline earth metal hydroxide is calcium hydroxide, magnesium hydroxide, barium hydroxide, or mixtures thereof; and (iii) 5 to 16 wt % of a fatty acid, wherein the fatty acid comprises at least one of oleic acid, stearic acid, ricinoleic acid, 12-hydroxystearic acid, or combinations thereof; and (iv) 1 to 15 wt % of water, to form an anhydrous grease;

II. admixing to the anhydrous grease (i) 1 to 22.5 wt % of an overbased metal detergent solubilized in a liquid diluent; (ii) 0.2 to 8.0 wt % of an oxygenate promoter; and (iii) 1 to 15 wt % of water, to form the hybrid grease.

17. The method of claim 16, wherein the admixture of step (I) is mixed and heated between 7° and 90° C. for 1 to 2 hours.

18. The method of claim 16, wherein the anhydrous grease of step (I) has at least one FTIR spectra peak between 1540 to 1600 $cm^{-1}$.

19. The method of claim 16, wherein the admixture of step (II) is mixed and heated between 70 to 95° C. for 1 to 2 hours.

20. The method of claim 16, wherein the hybrid grease of step II has at least one FTIR spectrum peak ranging from 850 to 900 $cm^{-1}$.

21. The hybrid grease of claim 15 or 16, wherein the dropping point of the hybrid grease is greater than 220° C., as measured using the dropping point test ASTM D2265.

* * * * *